US005213257A

United States Patent [19]

Sauerwine

[11] Patent Number: 5,213,257

[45] Date of Patent: May 25, 1993

[54] V-FOLD MAILER WITH RETURN ENVELOPE

[75] Inventor: Dean N. Sauerwine, Zionsville, Pa.

[73] Assignee: Moore Business Forms, Inc., Grand Island, N.Y.

[21] Appl. No.: 923,579

[22] Filed: Aug. 3, 1992

[51] Int. Cl.[5] ..... B65D 27/04; B65D 27/06

[52] U.S. Cl. ..... 229/304; 229/92.3

[58] Field of Search ..... 229/92.1, 92.3, 304, 229/306

[56] References Cited

U.S. PATENT DOCUMENTS

| | | | |
|---|---|---|---|
| 786,436 | 4/1905 | Goodman | 229/92.1 |
| 1,635,278 | 7/1927 | Kaplan | 229/306 |
| 2,846,135 | 8/1958 | Hiersteiner | 229/73 |
| 2,983,431 | 5/1961 | Turan | 229/92.3 |
| 3,837,565 | 9/1974 | Johnsen | 229/92:1 |
| 3,863,835 | 2/1975 | Gendron | 229/69 |
| 3,952,942 | 4/1976 | O'Leary et al. | 229/69 |
| 4,487,360 | 12/1984 | Fisher et al. | 229/73 |
| 4,669,652 | 6/1987 | Seguin | 229/306 |
| 4,715,531 | 12/1987 | Stewart et al. | 229/73 |
| 4,911,354 | 3/1990 | Lombardo | 229/69 |
| 4,927,072 | 5/1990 | Jenkins et al. | 229/92.3 |

*Primary Examiner*—Stephen P. Garbe

*Attorney, Agent, or Firm*—Nixon & Vanderhye

[57] ABSTRACT

An intermediate for a mailer type business form, and a mailer type business form, are constructed by the simple V-folding of a single sheet of paper, yet provide a return envelope. The return envelope is constructed from pressure sensitive adhesive strips covered with release liner strips and a rewettable glue strip provided on one of the panels of the V-folded sheet, while the panel has printing on its entire inner face. The outgoing address is printed on the second panel near one of the pressure sensitive adhesive strips, and is viewed from the exterior of the mailer through a cutout (with transparent patch) formed in the first panel.

22 Claims, 3 Drawing Sheets

V-FOLD MAILER WITH RETURN ENVELOPE

BACKGROUND AND SUMMARY OF THE INVENTION

It is desirable to construct mailer type business forms so that they are as simple as possible, provide a return envelope, yet are able to convey as much information as possible to the recipient. These often conflicting requirements are provided according to the present invention by making a reusable mailer out of a single sheet of paper (e.g. a $9\frac{1}{2} \times 12$ inch sheet) which may be simply V-folded so that substantially the entire inner face of the mailer may be printed with useful information. Despite the simplicity, however, the mailer may be constructed into a return envelope by using dormant strips of adhesive formed on one of the panels of the mailer on the interior surface thereof, which dormant adhesive is activated to form a return envelope. Typically the outgoing address is printed on what becomes the inner portion of the return envelope so that the ultimate recipient of the return envelope will know who it is from. Also, a cutout (typically covered by a transparent patch) is provided in the first panel over the outgoing address so that the outgoing address is visible from the exterior of the mailer.

According to one aspect of the present invention, an intermediate for a mailer type business form is provided which comprises the following elements: A sheet of paper having a rectangular configuration with first and second end, parallel edges; and third and fourth side, parallel edges; and having a first face and a second face. A first fold line parallel to the first and second edges, dividing the sheet into first and second panels of substantially equal dimension, the first panel between the first edge and the first fold line, and the second panel between the second edge and the first fold line. Outgoing address indicia printed on the first face of the second panel adjacent, but spaced from, the second edge. Means defining a cutout in the first panel adjacent, but spaced from, the first edge, the cutout being dimensioned and positioned so that when the first panel is folded about the first fold line to bring the first faces of the first and second panels together, the cutout overlies the outgoing address so that the outgoing address is visible from the exterior of the first panel. Permanent adhesive means disposed on the first face of the sheet adjacent at least the third and fourth edges thereof. And, patterns of dormant adhesive formed on the second panel first face for use in constructing a return envelope from the second panel when detached from the first panel along the first fold line.

Typically a second fold line is disposed perpendicular to the first fold line and extending from the first fold line toward the second edge, in the second panel, and located in a central portion of the second panel.

Also, first and second lines of weakness are typically formed in the sheet parallel to and adjacent the third and fourth edges, the permanent adhesive means including patterns of adhesive disposed between the third edge and the first line of weakness, and the fourth edge and the second line of weakness, respectively. The permanent adhesive means may also comprise an additional pattern of adhesive disposed on the first face adjacent and parallel to one or both of the second and first edges, and third and fourth lines of weakness formed in the sheet parallel to and adjacent the first and second edges, the additional pattern of adhesive disposed between one or both of the first and second edges and the third and fourth lines of weakness.

The patterns of dormant adhesive may comprise a first pattern of dormant adhesive on a first side of the second fold line, parallel to it and adjacent, but spaced from, the first edge on the first face of the second panel. The second and third panels of dormant adhesive may include a second pattern disposed adjacent and parallel to the first fold line on a second side of the second fold line, opposite the first side, and the third pattern is disposed adjacent the second edge, between the second edge and the outgoing address indicia, and parallel to the second edge and on the second side of the first face of the second panel. The first pattern of dormant adhesive may comprise a rewettable strip of adhesive, while the second and third patterns of dormant adhesive comprise strips of pressure sensitive adhesive covered by release liner strips.

Information may be printed on substantially the entire first face of the first panel except at the cutout, and even on the entire first face of the second panel except where the stripe of adhesive are located. The cutout is typically covered by a transparent patch. Reply address indicia may be printed on the second face of the second panel, extending in a dimension perpendicular to the dimension that the outgoing address extends in.

According to another aspect of the present invention, an intermediate for a mailer type business form is provided comprising the following elements: A sheet of paper having a rectangular configuration with first and second end, parallel edges; and third and fourth side, parallel edges; and having a first face and a second face. A first fold line parallel to the first and second edges, dividing the sheet into first and second panels of substantially equal dimension, the first panel between the first edge and the first fold line, and the second panel between the second edge and the first fold line. Permanent adhesive means disposed on the first face of the sheet adjacent at least the third and fourth edges thereof. And, patterns of dormant adhesive formed on the second panel first face for use in constructing a return envelope from the second panel when detached from the first panel along the first fold line. A second fold line disposed perpendicular to the first fold line and extending from the first fold line toward the second edge in the second panel, and located in a central portion of the second panel. First and second lines of weakness formed in the sheet parallel to and adjacent the third and fourth edges, the permanent adhesive means including patterns of adhesive disposed between the third edge and the first line of weakness, and the fourth edge and the second line of weakness, respectively. And, wherein the patterns of dormant adhesive comprise a first pattern of dormant adhesive on a first side of the second fold line, parallel thereto, and adjacent, but spaced from, the first edge, on the first face of the second panel; and second and third patterns of dormant adhesive, the second pattern disposed adjacent and parallel to the first fold line and on a second side of the second fold line opposite the first side; and the third pattern disposed adjacent the second edge, between the second edge and the outgoing address indicia, and parallel to the second edge and on the second side of the first face of the second panel.

The invention also contemplates a mailer type business form which comprises the following elements: First and second end, parallel edges. Third and fourth side, parallel, edges. First and second panels formed from a V-folded single sheet of paper, having inner faces and outer faces. Outgoing address indicia printed on the inner face of the second panel adjacent the second end. Means defining a cutout in the first panel overlying the outgoing address indicia so that the outgoing address indicia is visible through the cutout from the exterior of the first panel. Permanent adhesive means disposed along the side edges for holding the panels together. And, first, second, and third patterns of dormant adhesive disposed on the second panel first face, the first pattern parallel to and adjacent, but spaced from, the third edge; the second pattern disposed adjacent and parallel to the first end of the mailer; and the third pattern disposed between the second edge and the outgoing address, and parallel to the second edge.

Finally, the invention also contemplates a return envelope constructed from a reusable mailer. The return envelope comprises: A single sheet of paper having first and second parallel end edges, and third and fourth parallel side edges, and a fold line parallel to the end edges and defining the sheet into first and second panels, the dimension of the first panel between the fold line and first edge being substantially less than the dimension of the second panel between the fold line and the second edge to define a return envelope flap in the second panel, and each panel having first and second faces. Reply address indicia printed on the second face of one of the panels. Outgoing address indicia printed on the first face of one of the panels, remote from the flap. A first pattern of dormant adhesive disposed on the first face of the second panel, on the flap, adjacent the second end of the sheet of paper. And, means for holding the first faces of the first and second panels together to define a return envelope.

In the return envelope, the means for holding the first faces of the first and second panels together comprise second and third patterns of dormant adhesive disposed along one or both of the first faces of the first and second panels adjacent the side edges of the envelope. The first strip of dormant adhesive is preferably a rewettable adhesive strip, while the second and third patterns of dormant adhesive comprise strips of pressure sensitive adhesive covered by release liner strips. The outgoing address is printed on the first panel adjacent the third strip of dormant adhesive, and the reply address is printed on the second face of the second panel.

It is the primary object of the present invention to provide a simple, versatile, and effective intermediate for a mailer type business form, a mailer constructed from the intermediate, and a return envelope constructed from the reusable mailer. This and other objects of the invention will become clear from an inspection of the detailed description of the invention and from the appended claims.

DETAILED DESCRIPTION OF THE DRAWINGS

Figure 1:
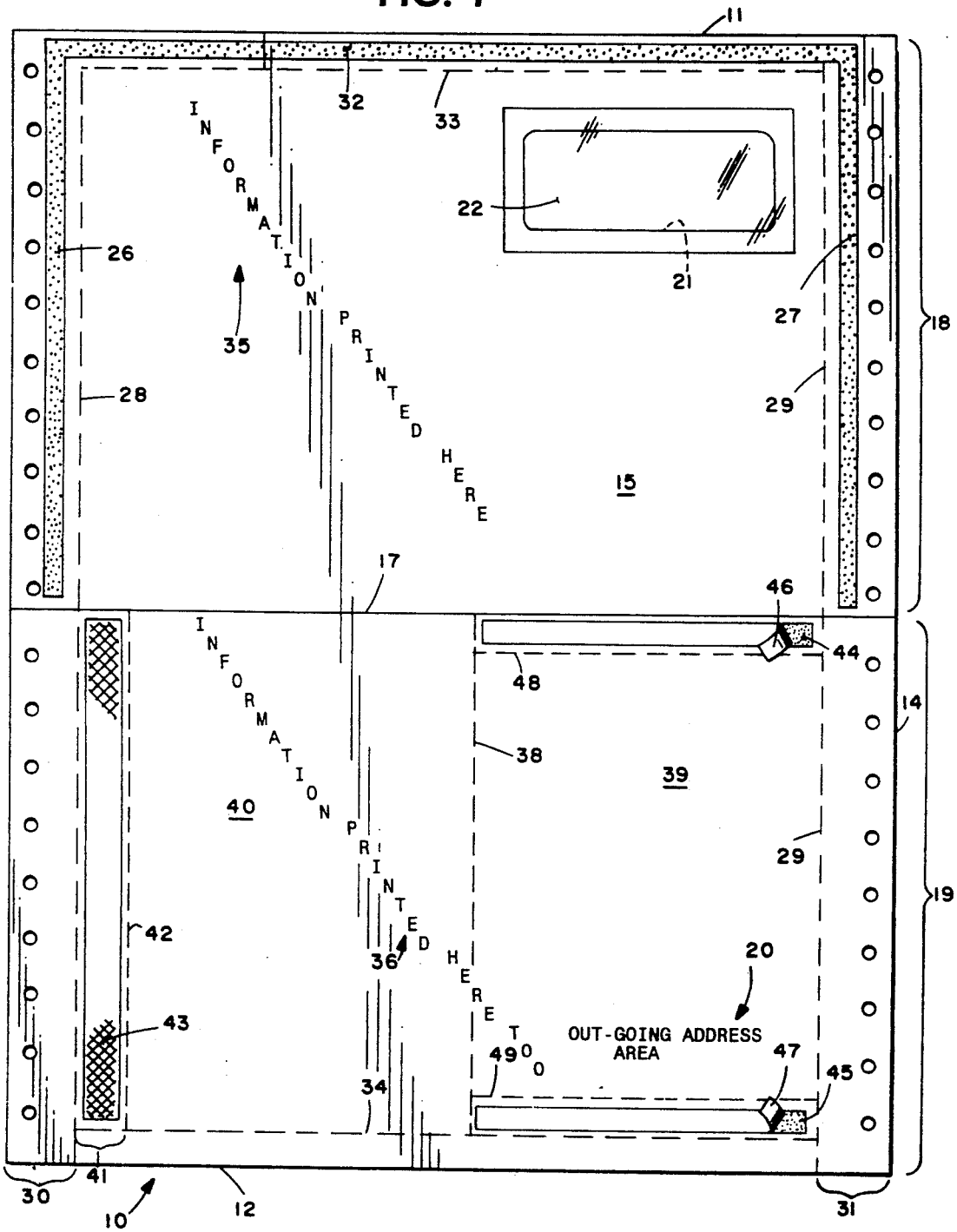
FIG. 1 is a top plan view of a first face of an intermediate for a mailer type business form according to the invention.
Figure 2:
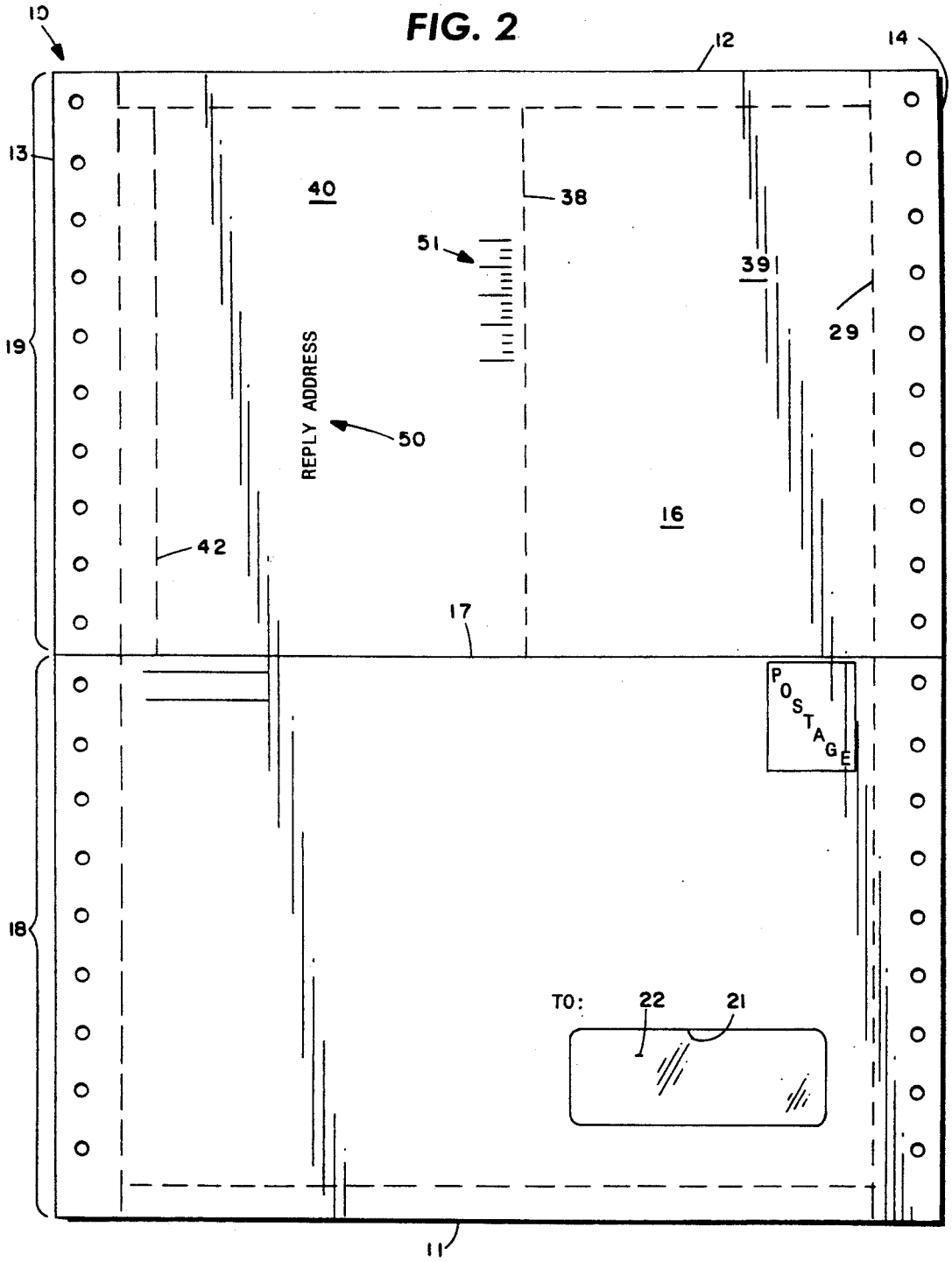
FIG. 2 is a top plan view of a second face of the intermediate of FIG. 1.

An intermediate for a mailer type business form according to the invention is illustrated generally by reference numeral 10 in FIGS. 1 and 2. The intermediate is formed from a single sheet of paper having a rectangular configuration with first and second end, parallel edges 11, 12, respectively, and third and fourth side, parallel edges 13, 14, respectively. The sheet of paper 10 has a first face 15 (FIG. 1) and a second face 16 (FIG. 2). A first fold line 17 parallel to the edges 11, 12 essentially bisects the sheet 10, dividing it into first and second panels 18, 19 of substantially equal dimension.

Outgoing address indicia 20 is printed on the first face 15 of the second panel 19 adjacent, but spaced from, the second edge 12. A cutout 21 is formed in the first panel 18, and it is preferably covered by a transparent (e.g. glassine) patch 22. The cutout 21 has substantially the same dimensions as the outgoing address 20, so that when the sheet 10 is folded about the fold line 17 with the first faces 15 of the panels 18, 19 in contact with each other, the cutout 21 and patch 22 overlie the outgoing address area 20 so that the outgoing address 20 is visible from the exterior of the mailer.

Figure 3:
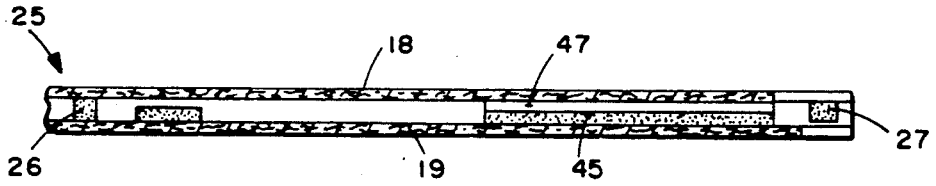
FIG. 3 is a side view, partly in cross-section and partly in elevation, of a mailer constructed from the intermediate of FIGS. 1 and 2.

Permanent adhesive is provided for holding the first faces of panels 18, 19 in face to face contact with each other in the final mailer 25 (see FIG. 3) that is constructed. The permanent adhesive preferably comprises a first pattern (e.g. strip) of heat sealable glue 26 applied to panel 18 adjacent the third edge 13, and a second like strip of heat seal glue 27 applied adjacent the fourth edge 14. First and second lines of weakness (typically perforations) 28, 29 are provided on the opposite side of, and adjacent and parallel to, the adhesive strips 26, 27 respectively from the edges 13, 14, the perforations 28, 29 defining removable edge marginal portions 30, 31 of the sheet 10.

The permanent adhesive also may optionally include the strip 32 of heat seal adhesive (see FIG. 1) extending adjacent and parallel to the first edge 11 on the first panel 18. Third and fourth lines of weakness (perforations) 33, 34 are provided spaced from the first and second edges 11, 12 respectively a distance at least equal to the width of the strip 32, the perforations 33, 34 being parallel to the edges 11, 12.

Preferably the first face 15, at least for the first panel 18 thereof, is essentially completely covered with information 35 which is printed thereon (except where the cutout 21 and glassine patch 22 are). If desired similar information 36 may be printed covering the majority of the second panel 19 first face 15 too. Thus a great deal of information can be transmitted to the recipient of the mailer 25 even though only a single sheet of paper 10 is utilized to construct the mailer 25.

Figure 4:
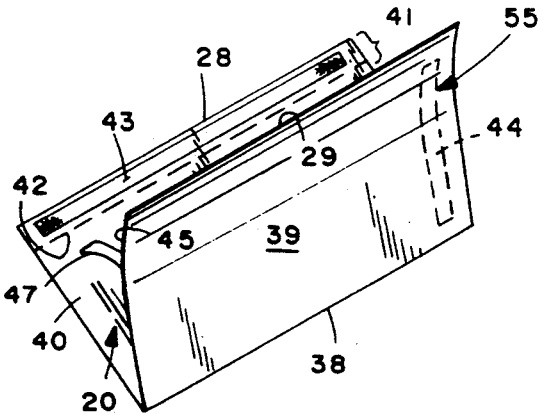
FIG. 4 is a rear perspective view of a return envelope that can be constructed from the mailer of FIG. 3, and the intermediate of FIGS. 1 and 2.
Figure 5:
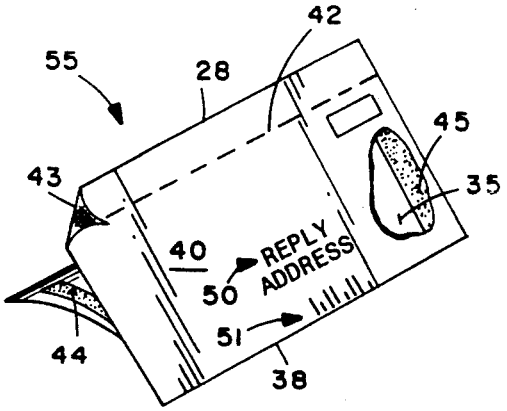
FIG. 5 is a front perspective view of the return envelope of FIG. 4.

In order to facilitate construction of a return envelope from the intermediate 10 and mailer 25, it is preferred that the first fold line 17 is a line of weakness (e.g. perforation). Also a second fold line 38 (which is preferably a score line rather than a line of weakness) is provided which extends perpendicular to the first fold line 17 between the first fold line 17 and the fourth line of weakness 34, and at a central portion of the second panel 19, and parallel to the edges 13, 14. The second fold line 38 divides the second panel 19 into third and fourth panels, the third panel—shown by reference numeral 39 in FIG. 1—being disposed to the right of the second fold line 38, between the fold line 38 and perforation 29 on two sides, and the fold line 17 and the perforation 34 on the other side. The fourth panel—shown generally by reference numeral 40—is longer than the third panel 39 by substantially the width of the flap 41 (see FIGS. 1, 4, and 5). Another fold line 42 may be provided in the fourth panel 40 parallel to the perforation line 28 to define the flap 41.

The intermediate 10 also includes patterns of dormant adhesive formed on the second panel 19 first face 15 for use in constructing the return envelope from the second panel 19 once it is detached from the first panel 18 along the fold line 17. The patterns of dormant adhesive preferably comprise a first strip 43 of rewettable glue which is disposed on the first face 15 in the flap portion 41, and second and third strips 44, 45 respectively of pressure sensitive adhesive covered by release liner strips 46, 47, respectively. The second strip 44 is adjacent and parallel to the first fold line 17 in the third panel 39, while the strip 45 is adjacent and parallel to the perforation 34 in the third panel 39. The third strip 45 is between the outgoing address 20 and the perforation line 34 (and second edge 12). If desired, additional lines of weakness (perforations) 48, 49, parallel to and just inside the strips 44, 45, may be provided to allow easy detachment of the return envelope once it is received by the ultimate recipient thereof.

Also forming part of the return envelope is the reply address indicia 50 (see FIG. 2) printed on the second face 16 of the second panel 19, in fact on the second face 16 of the fourth panel 40. The reply address 50 may include bar coding 51. Indicia (not shown) may also be printed on the second face 16 of the fourth panel 40 telling the recipient of the mailer 25 how to construct the return envelope.

The mailer 25 is formed by V-folding the panels 18, 19 about the fold line 17 so that the first faces 15 thereof come in contact with each other. Then it is run through a heat sealer, causing the heat seal glue strips 26, 27, 32 to be activated and thereby seal the mailer 25 closed, with the outgoing address 20 visible through the cutout 21. When the mailer is received by the outgoing addressee, the addressee detaches it along the perforations 28, 29, 33, 34, and then folds it about the fold line 17 to view all of the information 35, 36 printed therein. Once the information has been viewed and it is desired to return a check, or information, to the entity mailing the mailer 25, the first panel 18 is separated from the second panel 19 along the fold/perforation line 17, and then the return envelope—shown schematically by reference numeral 55 in FIGS. 4 and 5—is constructed.

The return envelope 55 has end edges 28, 38, and is formed by folding the panels 39, 40 with respect to each other about a second fold line 38. Then the release liner strips 46, 47 are removed from the strips of pressure sensitive adhesive 44, 45 (as illustrated schematically in FIGS. 4 and 5), and the panels 39, 40 are brought into face to face engagement and pressure is applied along the strips 44, 45 to seal the two sides of the return envelope 55. Then the appropriate insert may be inserted between the edge 29 and the flap 41, and then the rewettable adhesive 43 wet. The flap 41 is then folded about the fold line 42 to move the adhesive strip 43 in contact with the third panel 39, thereby completing the final envelope 55. Note that the outgoing address 20 is within the return envelope 55, so that when the recipient of the return envelope 55 receives it, the recipient can determine who it was sent from if that information is not otherwise properly provided. To facilitate opening of the return envelope 55, the optional perf lines 48, 49 may be provided.

It will thus be seen that according to the present invention a simple yet effective intermediate 10 for a mailer type business form may be provided, which allows a minimum amount of paper and thickness of form to transmit a maximum amount of information. The mailer 25 constructed from the intermediate is easy to utilize, and to construct a return envelope from, and the return envelope 55 according to the invention meets U.S. P.S. requirements (typically being about $3\frac{3}{4}$ inches$\times 5\frac{1}{2}$ inches if the original sheet 10 is $9\frac{1}{2}\times 12$ inches), and contains the outgoing address 20 within it.

While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent structures and devices.

What is claimed is:

1. An intermediate for a mailer type business form, comprising:

a sheet of paper having a rectangular configuration with first and second end, parallel edges; and third and fourth side, parallel edges; and having a first face and a second face;

a first fold line parallel to said first and second edges, dividing said sheet into first and second panels of substantially equal dimension, said first panel between said first edge and said first fold line, and said second panel between said second edge and said first fold line;

outgoing address indicia printed on said first face of said second panel adjacent, but spaced from, said second edge;

a cutout in said first panel adjacent, but spaced from, said first edge, said cutout being dimensioned and positioned so that when said first panel is folded about said first fold line to bring said first faces of said first and second panels together, said cutout overlies said outgoing address so that said outgoing address is visible from the exterior of said first panel;

permanent adhesive disposed on said first faced of said sheet adjacent at least said third and fourth edges thereof; and patterns of dormant adhesive formed on said second panel first face for use in constructing a return envelope from said second panel when detached from said first panel along said first fold line.

2. An intermediate as recited in clam 1 further comprising a second fold line disposed perpendicular to said first fold line and extending from said first fold line toward said second edge in said second panel, and located in a central portion of said second panel.

3. An intermediate as recited in claim 2 wherein said patterns of dormant adhesive comprise a first pattern of dormant adhesive on a first side of said second fold line, parallel thereto, and adjacent, but spaced from, said first edge, on said first face of said second panel; and second and third patterns of dormant adhesive, said second pattern disposed adjacent and parallel to said first fold line and on a second side of said second fold line, opposite said first side; and said third pattern disposed adjacent said second edge, between said second edge and said outgoing address indicia, and parallel to said second edge and on said second side of said first face of said second panel.

4. An intermediate as recited in claim 3 wherein said first pattern of dormant adhesive comprises a rewettable strip of adhesive.

5. An intermediate as recited in claim 4 wherein said second and third patterns of dormant adhesive comprise strips of pressure sensitive adhesive covered by release liner strips.

6. An intermediate as recited in claim 1 further comprising first and second lines of weakness formed in said sheet parallel to and adjacent said third and fourth edges, said permanent adhesive including patterns of adhesive disposed between said third edge and said first line of weakness, and said fourth edge and said second line of weakness, respectively.

7. An intermediate as recited in claim 6 wherein said permanent adhesive means further comprises an additional pattern of adhesive disposed on said first face adjacent and parallel to both of said first and second edges; and third and fourth lines of weakness formed in said sheet parallel to and adjacent said first and second edges, said additional pattern of adhesive disposed between one or both of said first and second edges and said third and fourth lines of weakness.

8. An intermediate as recited in claim 6 wherein said patterns of dormant adhesive comprise a first pattern of dormant adhesive disposed adjacent said first line of weakness on the opposite side thereof from said permanent adhesive, and parallel to said first line of weakness; and second and third patterns of dormant adhesive each parallel to said first fold line, and said second pattern disposed adjacent said first fold line on said second panel first face, and said third pattern disposed adjacent said second edge between said outgoing address indicia and said second edge.

9. An intermediate as recited in claim 8 wherein said first pattern of dormant adhesive comprises a rewettable strip of adhesive.

10. An intermediate as recited in claim 9 wherein said second and third patterns of dormant adhesive comprise strips of pressure sensitive adhesive covered by release liner strips.

11. An intermediate as recited in claim 6 wherein said permanent adhesive means further comprises an additional pattern of adhesive disposed on said first face adjacent and parallel to one of said first and second edges; and third and fourth lines of weakness formed in said sheet parallel to and adjacent said first and second edges, said additional pattern of adhesive disposed between one or both of said first and second edges and said third and fourth lines of weakness.

12. An intermediate as recited in claim 11 wherein said patterns of dormant adhesive comprise a first pattern of dormant adhesive disposed adjacent said first line of weakness on the opposite side thereof from said permanent adhesive, and parallel to said first line of weakness; and second and third patterns of dormant adhesive each parallel to said first fold line, and said second pattern disposed adjacent said first fold line on said second panel first face, and said third pattern disposed adjacent said fourth line of weakness between said outgoing address indicia and said fourth line of weakness.

13. An intermediate as recited in claim 12 further comprising reply address indicia printed on said second face of said second panel, extending in a dimension perpendicular to the dimension said outgoing address extends in.

14. An intermediate as recited in claim 1 further comprising information printed on substantially the entire first face of said first panel except at said cutout; and wherein said cutout is covered by a transparent patch.

15. An intermediate as recited in claim 1 further comprising reply address indicia printed on said second face of said second panel, extending in a dimension perpendicular to the dimension said outgoing address extends in.

16. An intermediate for a mailer type business form, comprising:

a sheet of paper having a rectangular configuration with first and second end, parallel edges; and third and fourth side, parallel edges; and having a first face and a second face;

a first fold line parallel to said first and second edges, dividing said sheet into first and second panels of substantially equal dimension, said first panel between said first edge and said first fold line, and said second panel between said second edge and said first fold line;

permanent adhesive disposed on said first face of said sheet adjacent at least said third and fourth edges thereof; and patterns of dormant adhesive formed on said second panel first face for use in constructing a return envelope from said second panel when detached from said first panel along said first fold line;

a second fold line disposed perpendicular to said first fold line and extending from said first fold line toward said second edge in said second panel, and located in a central portion of said second panel;

first and second lines of weakness formed in said sheet parallel to and adjacent said third and fourth edges, said permanent adhesive including patterns of adhesive disposed between said third edge and said first line of weakness, and said fourth edge and said second line of weakness, respectively; and wherein said patterns of dormant adhesive comprise a first pattern of dormant adhesive on a first side of said second fold line, parallel thereto, and adjacent, but spaced from, said first edge, on said first face of said second panel; and second and third patterns of dormant adhesive, said second pattern disposed adjacent and parallel to said first fold line and on a second side of said second fold line, opposite said first side; and said third pattern disposed adjacent said second edge, and parallel to said second edge and on said second side of said first face of said second panel.

17. An intermediate as recited in claim 16 wherein said permanent adhesive further comprises an additional pattern of adhesive disposed on said first face adjacent and parallel to one or both of said first and second edges; and third and fourth lines of weakness formed in said sheet parallel to and adjacent said first and second edges, said additional pattern of adhesive disposed between one or both of said first and second edges and said third and fourth lines of weakness.

18. An intermediate as recited in claim 16 wherein said first pattern of dormant adhesive comprises a rewettable strip of adhesive.

19. An intermediate as recited in claim 18 wherein said second and third patterns of dormant adhesive comprise strips of pressure sensitive adhesive covered by release liner strips.

20. A mailer type business form comprising:

first and second end, parallel edges;

third and fourth side, parallel, edges;

first and second panels formed from a V-folded single sheet of paper, having inner faces and outer faces;

outgoing address indicia printed on said inner face of said second panel adjacent said second end;

a cutout in said first panel overlying said outgoing address indicia so that said outgoing address indicia is visible through said cutout from the exterior of said first panel;

permanent adhesive means disposed along said side edges for holding said panels together; and first, second, and third patterns of dormant adhesive disposed on said second panel first face, said first pattern parallel to and adjacent, but spaced from, said third edge; said second pattern disposed adjacent and parallel to said first end of said mailer; and said third pattern disposed between said second edge and said outgoing address, and parallel to said second edge.

21. A mailer as recited in claim 20 wherein said first pattern of dormant adhesive is a strip of rewettable adhesive, and wherein said second and third patterns are strips of pressure sensitive adhesive covered by release liner strips.

22. A mailer as recited in claim 21 further comprising first and second lines of weakness disposed on the opposite sides of said permanent adhesive from said third and fourth edges, and parallel to said third and fourth edges, said lines of weakness between said dormant patterns of adhesive and said third and fourth edges.

* * * * *